US008062579B2

(12) United States Patent
Lonardi et al.

(10) Patent No.: US 8,062,579 B2
(45) Date of Patent: Nov. 22, 2011

(54) DEVICE FOR MOVING A RUNNER

(75) Inventors: Emile Lonardi, Bascharage (LU); Giovanni Cimenti, Bertrange (LU); Paul Tockert, Luxembourg (LU); Martin Fobbe, Nittel (DE)

(73) Assignee: Paul Wurth S.A., Luxembourg (LU)

( * ) Notice: Subject to any disclaimer, the term of this patent is extended or adjusted under 35 U.S.C. 154(b) by 950 days.

(21) Appl. No.: 11/815,161

(22) PCT Filed: Jan. 30, 2006

(86) PCT No.: PCT/EP2006/050524

§ 371 (c)(1),
(2), (4) Date: Nov. 15, 2007

(87) PCT Pub. No.: WO2006/079661

PCT Pub. Date: Aug. 3, 2006

(65) Prior Publication Data

US 2008/0116435 A1 May 22, 2008

(30) Foreign Application Priority Data

Jan. 31, 2005 (LU) ..... 91134

(51) Int. Cl.
*C21B 7/14* (2006.01)

(52) U.S. Cl. ..... 266/142; 254/89 H

(58) Field of Classification Search ..... 414/458, 414/917; 266/142, 192, 143, 160; 254/89 H, 254/91

See application file for complete search history.

(56) References Cited

U.S. PATENT DOCUMENTS 1,555,637 A * 9/1925 Davis ..... 254/91

(Continued)

FOREIGN PATENT DOCUMENTS

DE 11 13 662 9/1961

(Continued)

OTHER PUBLICATIONS

International Search Report; PCT/EP2006/050524; Mar. 20, 2006.

*Primary Examiner* — Charles A Fox

(74) *Attorney, Agent, or Firm* — Cantor Colburn LLP

(57) ABSTRACT

A device (10), for moving a runner (12) of a shaft furnace between an upper tapping floor level (42), where the runner is in an operational position in front of a taphole of the furnace, and a lower service level (40), where the runner is accessible for replacement. The device (10) comprises a first support (28) and a second support (34) forming a base member (38), a carrier member (20) for bearing the runner, the carrier member having a first and a second longitudinal portion, a first lifting member (22) connected via a first articulation (26) to the first longitudinal portion and via a second articulation (30) to the first support, and a second lifting member (24) connected via a third articulation (32) to the second longitudinal portion and via a fourth articulation (36) to the second support. The base member (38), the carrier member (20) and the first and second lifting members (22, 24) together with the four articulations (26, 30, 32, 36) form a four-bar equivalent mechanism. According to the invention, the device further comprises a traction link (90) connected via a fifth articulation (92) to the first lifting member (22) and via a sixth articulation (94) to the second lifting member (24). The axes of rotation of the fifth and sixth articulations (92, 94) remain above the plane defined by the axes of rotation of the second and fourth articulations (30, 36) when the carrier member (20) is in a lower position reached by approaching, taking or traversing a change point configuration.

19 Claims, 5 Drawing Sheets

U.S. PATENT DOCUMENTS

| | | | | |
|---|---|---|---|---|
| 1,942,945 | A * | 1/1934 | Smith | 254/91 |
| 2,340,764 | A | 2/1944 | Makaroff | |
| 2,922,533 | A | 1/1960 | Pierre | |
| 4,828,228 | A * | 5/1989 | Kammerling et al. | 266/142 |
| 5,120,022 | A * | 6/1992 | Kubik | 254/124 |
| 5,184,914 | A * | 2/1993 | Basta | 405/3 |
| 2005/0235893 | A1 * | 10/2005 | Hey et al. | 114/44 |

FOREIGN PATENT DOCUMENTS

| | | |
|---|---|---|
| DE | 36 24 266 | 1/1988 |
| GB | 975 154 | 11/1964 |
| JP | 09 111324 | 8/1997 |

* cited by examiner

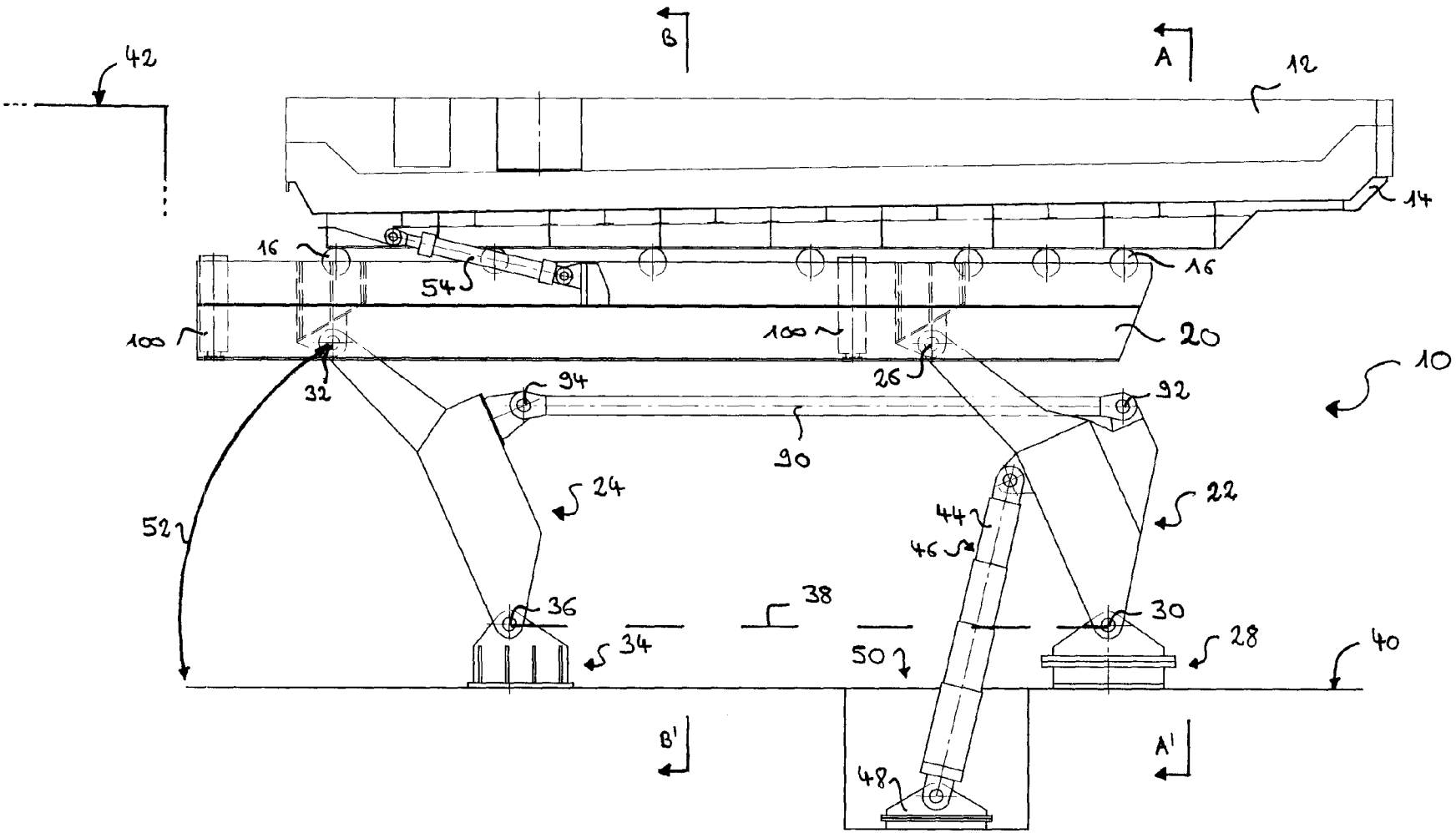
- Fig. 1 -

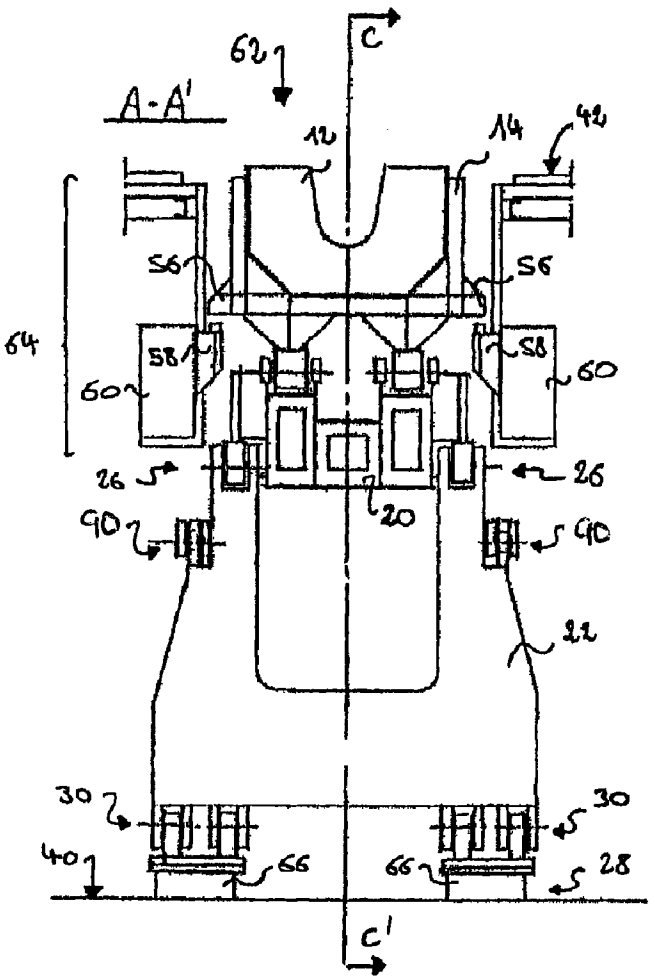
- Fig. 2 -
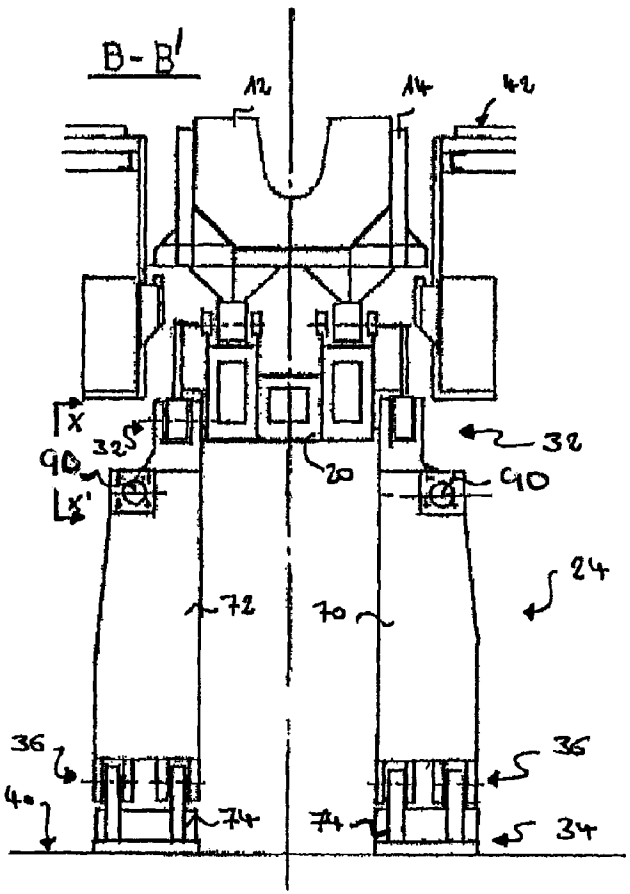
- Fig. 3 -

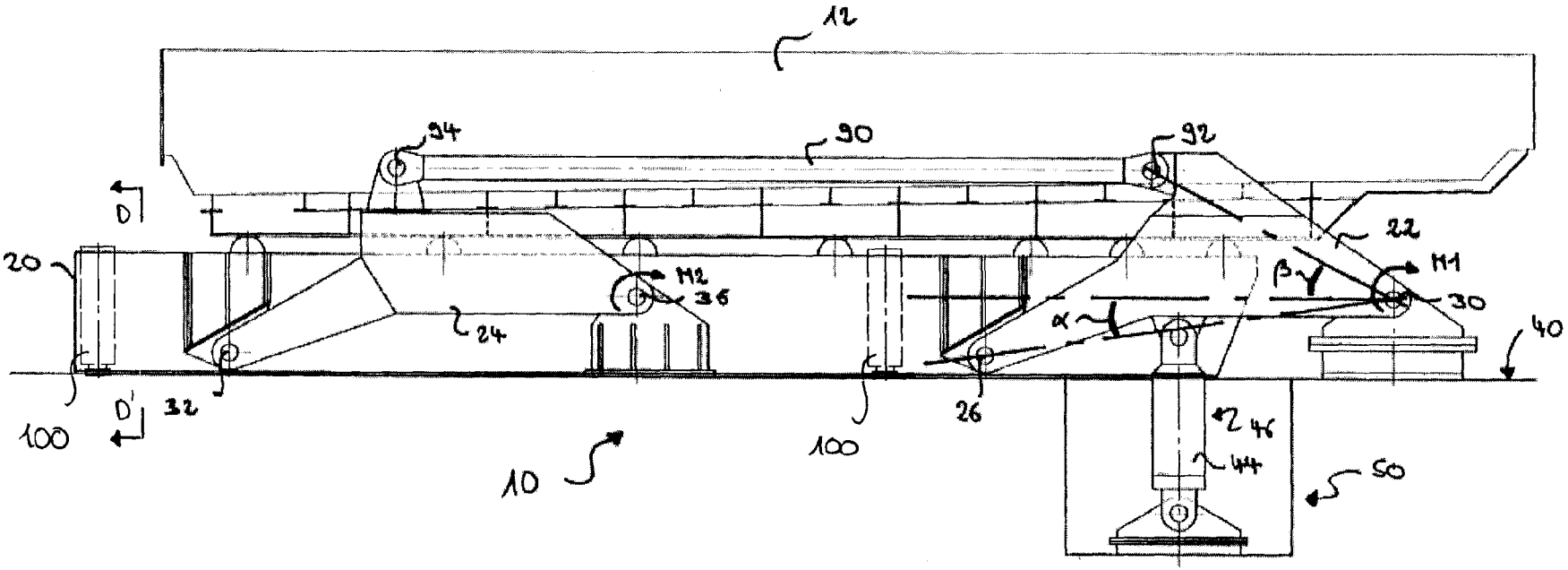
- Fig. 4 -

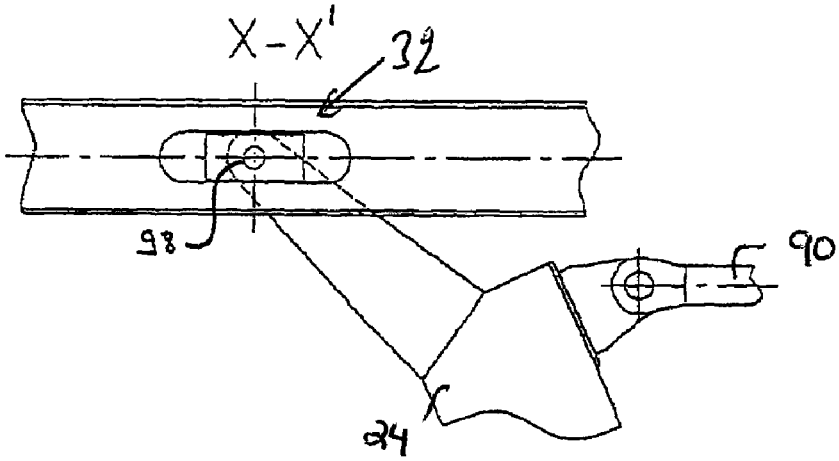
- Fig. 6 -
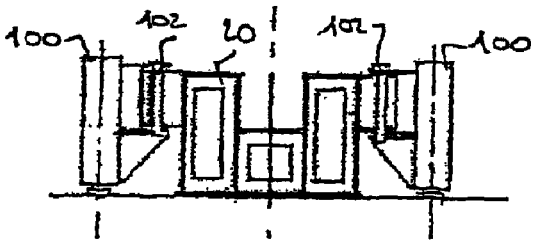
- Fig. 7 -
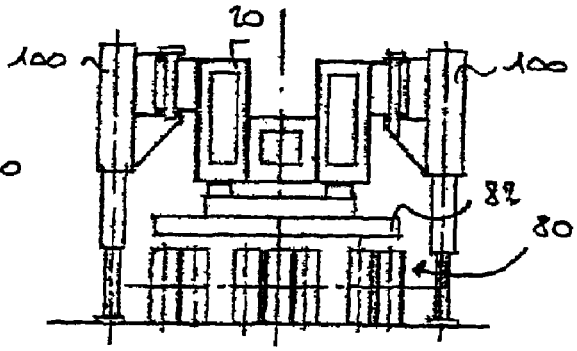
- Fig. 9 -
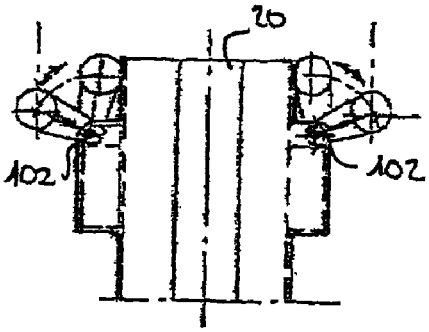
- Fig. 8 -
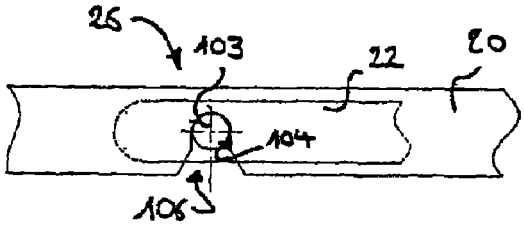
- Fig. 10 -

DEVICE FOR MOVING A RUNNER

TECHNICAL FIELD OF THE INVENTION

The present invention relates to a device for moving a runner of a shaft furnace and in particular to a device for use in the replacement operation of a blast furnace main runner.

BRIEF DISCUSSION OF RELATED ART

During tapping, pig iron and pig iron slag are separated in a main runner also called main trough. Such main runners have large cross sections and are consequently of considerable size and weight. In general, several runner elements, such as tilting runners and discharge runners, are connected down-stream of the main runner.

In the case of normal operation of a blast furnace, the pig iron is tapped off at regular intervals. Depending on the production capacity, their frequency may vary between eight and twelve tappings over twenty-four hours. As a result of the order of several thousand tons of pig iron being discharged each day, the refractory lining of the main runner is subjected to considerable mechanical and thermal loads. This results in wear, which means that refurbishment work has to be carried out periodically on the main runner. This refurbishment work cannot normally be carried out on site within the normal time frame of a programmed shutdown of the blast furnace. This is the reason why the main runner is in general entirely replaced with a reserve runner refurbished beforehand.

A known approach for carrying out this replacement operation is to use a crane, generally available in the cast house. However, given that the mass of the main runner and its accessories is generally of the order of several hundred tons, the necessary support structure for the crane is often very expensive. Since the dimensions of the main runner may be up to 20 m in length, 3 m in width and 2 m in height, the necessary storage space is generally not available in the cast house. Handling such masses using a crane also involves substantial safety risks. Another known solution is to raise the main runner vertically from the ground floor of the factory up to a tapping floor by means of a special device.

This is accomplished in EP 0 279 165 by vertical traction elements, which are flexible or rigid and are fixed to the tapping floor or alternatively to the runner. A similar approach is described in DE 36 24 266 in which the lifting is accomplished by rigid lifting elements placed on the ground floor of the factory. Thus, the rest of the transporting of the replacement runner may be performed on a special vehicle. While these latter solutions allow to reduce the duration of the intervention work and require little constructive space, they do have some drawbacks. Their mechanical construction for example, especially the actuating means, must meet stringent requirements as regards lifting the masses in question. Moreover, both of these known devices have only limited mechanical stability. With the device known from EP 0 279 165, there is a risk of dropping and/or tilting the runner in case of failure of one of the actuating means or in case of rupture of one of the traction elements. Similarly, with the device known from DE 36 24 266, if one of the lifting elements buckles under its pressure load or one of the synchronization gears is jammed, the runner may tilt and/or drop. These solutions therefore entail considerable safety risks, especially when moving the runner.

OBJECT BRIEF SUMMARY OF THE INVENTION

The invention proposes an improved device for moving a runner, which more particularly warrants safety of operation and has improved mechanical stability.

This is achieved by a device, according to the invention, for moving a runner of a shaft furnace between an upper tapping floor level, where the runner is in an operational position in front of a taphole of the furnace, and a lower service level, where the runner is accessible for replacement. The device comprises a first support and a second support forming a base member, a carrier member for bearing the runner, the carrier member having a first and a second longitudinal portion, a first lifting member connected via a first articulation to the first longitudinal portion and via a second articulation to the first support, and a second lifting member connected via a third articulation to the second longitudinal portion and via a fourth articulation to the second support. The first and second supports, the carrier member and the first and second lifting members together with the four articulations form a four-bar equivalent mechanism. According to the invention, the device further comprises a traction link connected via a fifth articulation to the first lifting member and via a sixth articulation to the second lifting member, the device being arranged such that the axes of rotation of the fifth and sixth articulations remain above the plane defined by the axes of rotation of the second and fourth articulations when the carrier member is in a lower position reached by approaching, taking or traversing a position in which the axes of rotation of the first, second, third and fourth articulations are horizontally aligned.

The links of the four-bar equivalent mechanism are formed by the base member (frame or fixed link), the carrier member (coupler link) and the first and second lifting members (side links), while the joints are formed by the respective articulations there between. Accordingly, the articulations provide at least a rotational degree of freedom around parallel axes. In other words, each articulation comprises at least one revolute joint. The different rigid members together with the articulations form a closed chain providing stability in the longitudinal direction of the device, whereas the lateral dimension of the respective members and articulations provides lateral stability. As will be appreciated, a four-bar equivalent mechanism (or four bar linkage) as described above provides a particularly stable construction, which is mechanically simple and reliable.

In other technical fields, where the loads are usually less heavy, e.g. the field of workshop tools, lifting mechanisms based on the principle of the four bar linkage in general and on the parallelogram linkage in particular are well known. Such devices allow loads to be lifted and lowered with minimized risk of tilting or rolling off of the load during movement. Examples of such lifting devices are illustrated in U.S. Pat. Nos. 2,340,764, 2,922,533 and GB 975 154.

U.S. Pat. No. 2,922,533 discloses a hydraulic pipe lift for handling heavy pipes, which is based on a parallelogram linkage. This device comprises a base (frame or fixed link) and a platform (coupler link) connected to the base by means of a first pair of links (side link) and a parallel second pair of links (side link), both pairs being pivoted at the base and at the platform. A significant drawback in the device according to U.S. Pat. No. 2,922,533 is that it cannot be brought into a fully lowered or collapsed position in which the platform is lowered close to the base.

For the present application and for many other applications, it is however desirable that the load be lowered as far as possible. In other words, it should be possible to lower the link that bears the load (coupler link) as far as possible. With a four-bar mechanism, this implies that the mechanism approaches, reaches or traverses a configuration in which the centrelines of all four links of the mechanism become collinear, i.e. a position in which the axes of rotation of the four corresponding articulations are horizontally aligned. This configuration (also called change point or geometric lock) is problematic because the mechanism can toggle and force transmission becomes critical. In fact, when a first side link becomes aligned with the coupler link, the former can only be compressed or extended by the latter. In this configuration, a torque applied to the second side link cannot induce rotation in the first side link. The first link is therefore said to be at a dead point (sometimes called a toggle point). Force transmission can also become critical in a configuration near the change point, because very high torques/forces may be required at the actuated side link(s) to lift the coupler link. Obviously, the latter issue is not facilitated with heavier loads, such as blast furnace runners, on the coupler link.

One possibility to avoid the change point problem is of course to provide redundant actuating means on all side links. This approach is illustrated by U.S. Pat. No. 2,340,764, which discloses a lifting device for objects such as automotive vehicles. This device also comprises a base (fixed link) and a platform (coupler link) connected by parallel bars (side links) pivoted at the base and at the platform. In order to enable unproblematic lifting of the platform from a lower-most configuration in which the platform rests on the base, i.e. a configuration near the change point, a separate actuator is provided on each of the lifting bars.

Under certain circumstances, the latter solution is not viable because there is a requirement to actuate only one of the side links of the device, e.g. because of constructional or cost constraints. GB 975 154 describes one possible design of a lifting device operating with a single actuator and allowing collapsing of the four-bar mechanism into a configuration near the change point. The lifting apparatus according to GB 975 154 comprises a supporting platform linked to a base by means of a parallelogram linkage mechanism. A fluid operated ram for raising the platform is provided. This ram has a lever connected to its plunger. The lever is connected to one side link only. The lever is configured such that it can impart an initial upwardly directed propulsion force on the parallelogram linkage mechanism to initiate lifting and subsequently to impart an upwardly directed traction force the parallelogram linkage mechanism to complete the elevation of the platform. The linkage design according to GB 975 154 is relatively complex, among others because it is designed for lifting and lowering the platform in vertical direction only. In the design according to GB 975 154, an additional bearing and an additional roller are required for coupling the lever to the linkage and for providing initial support respectively. Without using expensive wear parts, e.g. the roller and the bearing, this device is not suitable for lifting very heavy loads. Moreover, the design according to GB 975 154 does not allow for a configuration to be taken in which the change point has been traversed. In fact, when the side links pass through the change point during lowering, the torque exerted by the first actuated side link on the second non-actuated side link is reversed, i.e. has opposite sense. In consequence, lifting the load out of such a configuration beyond the change point is not possible with the device according to GB 975 154.

Turning back to the field of maneuvering shaft furnace runners and the device according to the present invention, it will be appreciated that the traction link according to the invention provides a simple and economical alternative for resolving the aforementioned change point problem without requiring redundant actuators. Furthermore, the traction link allows collapsing the mechanism into a configuration beyond the change point, without causing negative torque at the non-actuated lifting member. By virtue of the traction link the mechanism can take or traverse the change point configuration. Hence it is possible to achieve a comparatively flat construction when the device is collapsed, despite the massive members of considerable dimensions needed for supporting the heavy loads involved with shaft furnace runners. It is also possible to lower the carrier member onto the service floor. By allowing the carrier member to rest on the service floor when lowered, the other members of the device are in no-load condition in this position. In addition, the device can be installed directly onto the service level floor.

In a preferred embodiment, the four-bar equivalent mechanism is a parallelogram four-bar equivalent mechanism. Constraining the motion of the carrier member to (horizontal) planes parallel to the base member, insures a horizontal orientation of the runner throughout the operation of the device, even in case of failure of an actuation means.

When allowing alignment or a configuration close to alignment of the first, second, third and fourth articulations, either the first articulation or the third articulation preferably provides an additional translational degree of freedom in the direction of an axis that is perpendicular to the axes of rotation of the first and third articulations, e.g. by means of a turning and sliding joint. This allows to eliminate transmission of tensile or compressive forces through the carrier member during the lifting and lowering operations.

The above measures allow for driving only a single member of the device without creating critical situations regarding force transmission. With these measures, the four-bar equivalent mechanism is preferably actuated by means of at least one, preferably two hydraulic cylinders driving the first lifting member. Although it is possible to use a single cylinder only, a second cylinder on the first lifting member provides redundancy for safety reasons. In this case, each cylinder is preferably designed for supporting the entire load of the device during operation.

Preferably, the first lifting member is designed as a U-shaped element so as to provide additional lateral stability to the device. Furthermore, the second lifting member advantageously comprises a first arm and a second arm disposed on either side of the carrier member.

In a simple and preferred design, the traction link comprises two drawbars, one drawbar being laterally jointed to either side of the first lifting member and to the first arm or the second arm respectively. Although a non-rigid traction link e.g. made of steel cables could be used, rigid drawbars are preferred inter alia for safety reasons.

In order to allow for removal of the device, the device advantageously comprises at least one detachable articulation and/or at least one detachable support. To facilitate such removal, the carrier member can comprise a plurality of hydraulic lifting jacks. Such lifting jacks allow to place at least part of the device onto a truck or railway wagon. This is advantageous if the device is to be used at a plurality of locations or if it constitutes an obstruction on the service floor, e.g. for torpedo ladle cars.

In a preferred embodiment, the runner is placed on a carriage which is longitudinally movable along the carrier member. A carriage acts as container structure for the runner and significantly facilitates the replacement operation of the runner. When using a carriage, the device preferably comprises means for communicating longitudinal motion to the carriage. This allows to position the carriage on the carrier member, e.g. in order to avoid obstacles during lifting and lowering or to place the carriage on supporting elements of the tapping floor ceiling. The carrier member may comprise a plurality of rollers supporting the carriage. Mounting the rollers on the carrier member avoids the necessity to provide rollers on all carriages. Such rollers are preferably spring supported in order to insure uniform wear and load distribution on the rollers by compensation for inevitable dimensional tolerances in the device and/or the carriage construction. As will be appreciated, the device according to the invention is particularly suitable for use of in the replacement operation of a blast furnace main runner.

BRIEF DESCRIPTION OF THE DRAWINGS

The present invention will be more apparent from the following description of a preferred embodiment with reference to the accompanying drawings, wherein:

FIG. 1: is longitudinal cross-sectional view of a device for moving a runner, with the runner being in an elevated position;

FIG. 2: is a lateral cross-sectional view along plane AA' of the device of FIG. 1;

FIG. 3: is a lateral cross-sectional view along plane BB' of the device of FIG. 1;

FIG. 4: is side view of the device of FIG. 1, with the runner being in a lowered position;

FIG. 6: is a partial side view of the device of FIG. 1, according to plane XX' of FIG. 3;

FIG. 7: is a lateral cross-sectional view along plane DD' of FIG. 4, showing hydraulic lifting jacks;

FIG. 8: is a partial top view according to FIG. 7;

FIG. 9: is a lateral cross-sectional view according to FIG. 7, with the hydraulic lifting jacks in unfolded and extended configuration;

FIG. 10: is a partial side view of a detachable articulation of the device of FIG. 1.

DETAILED DESCRIPTION OF THE INVENTION

Figure 5:
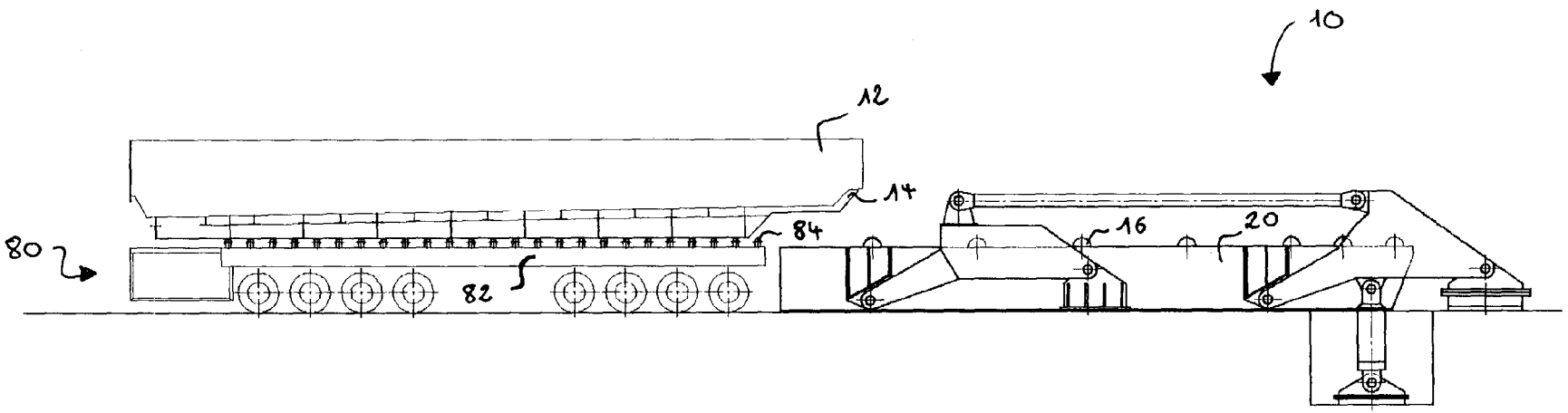
FIG. 5: is a side view of the device of FIG. 1 in lowered position, with the runner loaded onto a truck.

FIG. 1 shows a device, generally identified by reference numeral 10, for moving a runner of a shaft furnace. A main runner 12 of a blast furnace (not shown) is carried by a carriage 14 and located in front of a taphole (not shown) of the blast furnace. The carriage 14 is moveably supported by means of a plurality of rollers 16 on a carrier member 20 of the device 10. A first lifting member 22 is connected to the carrier member 20 by a first articulation 26 and to a first support 28 by a second articulation 30. A second lifting member 24 is connected to the carrier member 20 by a third articulation 32 and to a second support 34 by a fourth articulation 36. The first articulation 26 is arranged in a first longitudinal portion of the carrier member 20 on the taphole side while the third articulation 32 is arranged in a second longitudinal portion of the carrier member 20 remote from the taphole.

As further seen in FIG. 1, the first and second supports 28, 34 are located at a lower service level 40, i.e. below an upper tapping floor level 42. The first and second supports 28, 34 form a base member 38 (indicated by a dashed line). As is apparent from FIG. 1, the base member 38 represents the fixed link of a four-bar equivalent mechanism, wherein the other links are formed by the carrier member 20 and the first and second lifting members 22, 24 whereas the joints are formed by the articulations 26, 30, 32, 36. Accordingly, the articulations 26, 30, 32, 36 comprise hinges or revolute joints providing a rotational degree of freedom around parallel axes which are perpendicular to the plane of FIG. 1. As is also apparent from FIG. 1, the device 10 forms a parallelogram four-bar equivalent mechanism, whereby the runner 12 maintains a horizontal orientation during its displacement. Two telescopic hydraulic cylinders 44, 46 are provided for actuating the parallelogram four-bar equivalent mechanism (only cylinder 44 is visible in FIG. 1). The telescopic hydraulic cylinders 44, 46 are pivotably connected to the first lifting member 22 and a support base 48 provided in a recess 50 below the service level 40. By action of the telescopic hydraulic cylinders 44, 46, the device 10 can move the runner 12 up and down, between an operative position at the tapping floor level 42 and a replacement position at the service level 40, as indicated by circular arc shaped arrow 52.

A third hydraulic cylinder 54 is pivotably connected to the carriage 14 and to the second longitudinal portion of the carrier member 20. The third hydraulic cylinder 54 allows to position the carriage 14 longitudinally with respect to the carrier member 20. Referring to FIG. 2, it may be noted that the device 10 is generally symmetrical with respect to plane CC', i.e. the plane of FIG. 1. The third hydraulic cylinder 54 is arranged in the plane CC'. As seen in FIG. 2, lateral protrusions 56 on either side of the carriage 14 can be positioned above respective supporting elements 58. A plurality of such lateral protrusions 56 is provided along the length of the carriage 14. The supporting elements 58 are welded to supporting beams 60 arranged inside an opening 62 of a ceiling 64. The ceiling 64, which defines the tapping floor level 42, is capable of supporting the runner 12. Therefore, when the carriage 14 is longitudinally positioned, it can be lowered by the device 10 until it exclusively rests on the supporting elements 58. Afterwards, the device 10 can be lowered and possibly removed, since it no longer needs to provide a supporting function for the runner 12. The third hydraulic cylinder 54 is also used to correctly position the carriage 14 during the lifting or lowering operation carried out by the device 10. In this case, the third hydraulic cylinder 54 is operated in accordance with the lowering or lifting motion so as to warrant sufficient clearance from the longitudinal limits of opening 62 and/or any other hindering elements. As further seen in FIG. 2, the first lifting member 22 comprises a two-pronged fork, i.e. U-shaped element which provides stability in a lateral direction to the device 10. Also seen in FIG. 2 are the first and second articulations 26, 30 of the first lifting member 22 and the first support 28, which comprises a first set of support posts 66 mounted on the service floor 40.

Similarly, FIG. 3, shows the second lifting member 24 in more detail. The second lifting member 24 comprises a first arm 70 and a second arm 72 disposed on either side of the carrier member 20. Together with a second set of support posts 74 of the second support 34 and the third and fourth articulations 32, 36, the first and second arms 70, 72 provide additional lateral stability to the device 10. In addition, the separate arms 70, 72 allow lowering the carrier member 20 onto the service floor 40.

FIG. 4 shows the device 10 of FIG. 1, with the runner 12 and the carrier member 20 in a lowered position. As opposed to FIG. 1, the device 10 is shown in a collapsed configuration in FIG. 4. The first and second telescopic hydraulic cylinders 44 and 46 are completely contracted within the accordingly dimensioned recess 50, whereby the first and second lifting members 22, 24 are brought to their lowermost position. The carrier member 20 lies on the service floor level 40 which allows subsequent access to the carriage 14 holding the runner 12. In fact, this configuration allows to transfer the carriage 14 including the runner 12 onto a special purpose truck 80 as shown in FIG. 5. The carriage 14 can be pulled onto the truck 80, e.g. by means of a winch. To this effect, a loading floor 82 of the truck 80 is level with the upper surface of carrier member 20 and is provided with a plurality of truck rollers 84. It may be noted that the majority of the rollers 16 on the carrier member 20 and the truck rollers 84 are spring supported in a manner known per se so as to insure uniform wear and to compensate for dimensional tolerances. After the worn off runner 12 has been removed, a new refurbished runner is placed onto the carrier member 20 by proceeding in reverse manner as described above. The replacement operation is completed when the new refurbished runner is lifted up to the tapping floor level 42 and placed on the supporting elements 58 by means of the device 10 as shown in FIG. 2.

Turning back to the parallelogram four-bar equivalent mechanism, FIG. 1 shows an additional traction link 90 which is connected via a fifth articulation 92 to the first lifting member 22 and via a sixth articulation 94 to the second lifting member 24. As seen in FIG. 2 and FIG. 3, the traction link 90 comprises two drawbars, laterally jointed to either side of the first lifting member 22 and to the first and second arms 70, 72 of the second lifting member 24 respectively.

The function of the traction link 90 will be more apparent from FIG. 4. In order to lift the first longitudinal portion of the carrier member 20 with the carriage 14 and the runner 12, the telescopic hydraulic cylinders 44, 46 exert a lifting force onto the first lifting member 22. This force results in a first torque M1 about the second articulation 30. In order to lift the second longitudinal portion of the carrier member 20 with the second lifting member 24, a second torque M2 about to the fourth articulation 36 is required. In order to make the torque M2 equal to M1, a given lever arm is required. This lever arm depends on the magnitude and the direction of a force transmitted to the third articulation 32, since the distance between the third and fourth articulations 32, 36 is constant. The direction of this transmitted force depends on the configuration of the four-bar equivalent mechanism, whereas the maximum admissible magnitude is defined by the construction. Greek letter $\alpha$ indicates the angle included between a horizontal line through the second articulation 30 and the line connecting the second articulation 30 to the first articulation 26 in FIG. 4. The angle $\alpha$ determines the orientation of the force transmitted to the third articulation 32. In fact, with $\alpha$ approaching zero (change point or dead point), the tensile or compressive force, which is required to be transmitted through the connecting link (i.e. the carrier member 20) to induce a given torque M2, becomes enormous. Moreover, if $\alpha$ is negative, which means the first and third articulations 26, 32 are located below the aforementioned horizontal line, the resulting torque M2 is negative, i.e. opposite to M1 in orientation.

In order to overcome this (change point) problem, the traction link 90 provides an alternative force transmission path. Greek letter $\beta$ indicates the angle included between a horizontal line through the second articulation 30 and the line connecting the second articulation 30 to the fifth articulation 92 in FIG. 4. As will be appreciated, provision of the traction link 90 allows to design the device 10 such that the angle $\alpha$ may approach or take a zero value without causing the aforementioned problem. In fact as long as:

$$\beta >> 0$$

is assured, a sufficient lever arm at the third articulation 32, which results in a sufficient positive torque M2 at the fourth articulation 36, can be obtained even with the angle $\alpha$ approaching or taking a zero value or being negative. As a result, the device 10 can be brought into and out of a lowered position as shown in FIG. 4 and FIG. 5.

In presence of the traction link 90, it is undesirable to transmit tensile or compressive forces through the carrier member 20 in order to create the torque M2. In order to eliminate such undesirable forces, the third articulation 32 comprises two turning and sliding joints 98 as shown in FIG. 6, which is a side view according to plane XX' of FIG. 3. The turning and sliding joints 98 connect the arms 70, 72 to either side of the carrier member 20. The resulting additional translational degree of freedom insures that no tensile or compressive forces are transmitted through the carrier member 20 during lifting and lowering of the runner 12. It may be noted that such joints may alternatively be provided at the first articulation 26. An alternative solution to this problem would require additional actuating means provided on the second lifting member 24.

FIG. 7 shows two lateral hydraulic lifting jacks 100 arranged on the second longitudinal portion of the carrier member 20. As seen in FIG. 8, the hydraulic lifting jacks 100 are mounted on vertical hinges 102 so as to allow lateral unfolding and collapsing. FIG. 9 shows the hydraulic lifting jacks 100 in fully extended configuration. As shown in FIG. 1, two further lifting jacks are arranged on the first longitudinal portion of the carrier member 20. When unfolded and extended, the four hydraulic lifting jacks 100, allow positioning of the loading floor 82 of a truck 80 underneath the carrier member 20. After retraction and attachment of the hydraulic lifting jacks 100, the carrier member 20 can be transported without the need for any further equipment. Referring to FIG. 1, detachment of the first and fifth articulations 26, 92 and removal of the second set of support posts 74, allows to partially remove the device 10, e.g. if it constitutes an obstruction or if it is needed at a different location. To this effect, the second support posts 74 are kept in place by their load and form fit on the service floor 40 (not shown), such that simple removal is possible but displacement during operation is precluded. In addition, the first articulation 26 is simply detachable by a partial revolute joint designed as seen in FIG. 10. A shaft 103 of the articulation 26 is welded to the first lifting member 22, while a corresponding bearing bush 104 is provided in the carrier member 20. An aperture 106 to the semicircular bush 104 is provided in the carrier member 20, which allows lifting the carrier member 20 upwards and detaching it from the first lifting member 22 when it is in the position shown in FIG. 4. Only the U-shaped element of the first lifting member 22, the corresponding first support 28 and the telescopic hydraulic cylinders 44, 46 remain stationary, while the other parts can be removed. By providing second instances of the latter parts most of the parts of the device 10 can be used again e.g. at the side of a second taphole of the blast furnace (not shown). It is also possible to provide other removable configurations, e.g. with both supports 28, 34 being detachable so as to allow removal of the entire device 10, or with the second articulation 30 and the support base 48 being detachable. The described configuration however facilitates and reduces manual interventions during removal and installation of the device 10. As will be appreciated, the hydraulic lifting jacks 100 facilitate any such removal operation.

The invention claimed is:

1. Device for moving a runner of a shaft furnace between an upper tapping floor level, where the runner is in an operational position in front of a taphole of the furnace, and a lower service level, where the runner is accessible for replacement, comprising:

a first support and a second support forming a base member, a carrier member for bearing said runner, said carrier member having a first and a second longitudinal portion, said second portion being remote from said first portion in longitudinal direction, a first lifting member connected via a first articulation to said first longitudinal portion and via a second articulation to said first support, and a second lifting member connected via a third articulation to said second longitudinal portion and via a fourth articulation to said second support, which form a four-bar equivalent mechanism, and said device further comprising a traction link connected via a fifth articulation to said first lifting member and via a sixth articulation to said second lifting member such that the axes of rotation of said fifth and sixth articulations remain above the plane defined by the axes of rotation of said second and fourth articulations when said carrier member is in a lower position reached by taking or traversing the change point configuration of said four-bar equivalent mechanism.

2. Device according to claim 1, wherein said four-bar equivalent mechanism is a parallelogram four-bar equivalent mechanism.

3. Device according to claim 2, wherein said first articulation or said third articulation additionally provides a translational movement in the direction of an axis that is perpendicular to the axes of rotation of said first and third articulations.

4. Device according to claim 3, further comprising at least one hydraulic cylinders driving said first lifting member for actuating said four-bar equivalent mechanism.

5. Device according to claim 4, wherein said first lifting member is designed as a U-shaped element and said second lifting member comprises a first arm and a second arm disposed on either side of the carrier member.

6. Device according to claim 5, wherein said traction link comprises two drawbars, one drawbar being laterally jointed to either side of said first lifting member and to said first arm or said second arm respectively.

7. Device according to claim 1, wherein said device comprises at least one detachable articulation and/or at least one detachable support.

8. Device according to claim 7, wherein said carrier member comprises a plurality of hydraulic lifting jacks.

9. Device for moving a runner of a shaft furnace between an upper tapping floor level, where the runner is in an operational position in front of a taphole of the furnace, and a lower service level, where the runner is accessible for replacement, said device comprising a parallelogram four-bar equivalent mechanism including:

a first support and a second support forming a base member, a carrier member for bearing said runner, said carrier member having a first and a second longitudinal portion, said second portion being remote from said first portion in longitudinal direction, a first lifting member connected via a first articulation to said first longitudinal portion and via a second articulation to said first support, and a second lifting member connected via a third articulation to said second longitudinal portion and via a fourth articulation to said second support;

and said device comprising a traction link connected via a fifth articulation to said first lifting member and via a sixth articulation to said second lifting member wherein the axes of rotation of said fifth and sixth articulations remain above the plane defined by the axes of rotation of said second and fourth articulations when said carrier member is in a lower position reached by taking or traversing the change point configuration of said four-bar equivalent mechanism.

10. Device according to claim 9, further comprising a carriage which is longitudinally movable along said carrier member, said runner being placed on said carriage.

11. Device according to claim 10, comprising means for communicating longitudinal motion to said carriage.

12. Device according to claim 10, wherein said carrier member comprises a plurality of rollers supporting said carriage.

13. Device according to claim 12, wherein said rollers are spring supported.

14. Device for moving a runner of a shaft furnace between an upper tapping floor level, where the runner is in an operational position in front of a taphole of the furnace, and a lower service level, where the runner is accessible for replacement, said device comprising a parallelogram four-bar equivalent mechanism including:

a first support and a second support forming a base member, a carrier member for bearing said runner, said carrier member having a first and a second longitudinal portion, said second portion being remote from said first portion in longitudinal direction, a first lifting member connected via a first articulation to said first longitudinal portion and via a second articulation to said first support, and a second lifting member connected via a third articulation to said second longitudinal portion and via a fourth articulation to said second support;

wherein at least one of said articulations and/or at least one of said supports is detachable;

and said device further comprising a traction link connected via a fifth articulation to said first lifting member and via a sixth articulation to said second lifting member wherein the axes of rotation of said fifth and sixth articulations remain above the plane defined by the axes of rotation of said second and fourth articulations when said carrier member is in a lower position reached by taking or traversing the change point configuration of said four-bar equivalent mechanism.

15. Device according to claim 14, wherein said first articulation or said third articulation additionally provides a translational movement in the direction of an axis that is perpendicular to the axes of rotation of said first and third articulations.

16. Device according to claim 14, further comprising at least one hydraulic cylinders for actuating said four-bar equivalent mechanism by driving said first lifting member.

17. Device according to claim 14, wherein said first lifting member is designed as a U-shaped element and said second lifting member comprises a first arm and a second arm disposed on either side of the carrier member.

18. Device according to claim 17, wherein said traction link comprises two drawbars, one drawbar being laterally jointed to either side of said first lifting member and to said first arm or said second arm respectively.

19. Device according to claim 14, wherein said carrier member comprises a plurality of hydraulic lifting jacks for placing at least part of the device onto a truck or railway wagon.

* * * * *